US006145736A

United States Patent [19]

Ours et al.

[11] Patent Number: 6,145,736

[45] Date of Patent: Nov. 14, 2000

[54] DISPENSING ASSEMBLY FOR A LINED CARTON AND PROCESS AND APPARATUS THEREOF

[75] Inventors: David C. Ours, Marshall; James O. Robotham, Nashville; David L. Bradley; Michael Borgerson, both of Battle Creek, all of Mich.

[73] Assignee: Kellogg Company, Mich.

[21] Appl. No.: 09/150,966

[22] Filed: Sep. 10, 1998

Related U.S. Application Data

[63] Continuation-in-part of application No. 09/050,533, Mar. 30, 1998, Pat. No. 6,062,467.

[60] Provisional application No. 60/069,859, Dec. 17, 1997.

[51] Int. Cl.[7] ..... B65D 5/74

[52] U.S. Cl. ..... 229/117.3; 53/133.2; 53/133.4; 53/478; 229/117.31; 229/117.34; 229/125.04; 493/87; 493/95; 493/129; 493/907

[58] Field of Search ..... 229/117.3, 117.31, 229/117.35, 125.04, 125.09, 125.14, 125.15, 215, 217, 117.32, 117.33, 117.34; 53/133.2, 133.4, 281, 471, 478; 222/541.5, 572, 573, 556, 563, 527, 528, 533; 493/87, 95, 128, 129, 907

[56] References Cited

U.S. PATENT DOCUMENTS

| | | | |
|---|---|---|---|
| 2,536,529 | 1/1951 | Bergstein . | |
| 2,593,778 | 4/1952 | McGinnis . | |
| 2,701,679 | 2/1955 | Goldstein | 229/215 |
| 2,820,585 | 1/1958 | Nerenberg et al. . | |
| 2,998,788 | 9/1961 | Back et al. . | |
| 3,127,082 | 3/1964 | Meyer-Jagenberg . | |
| 3,250,436 | 5/1966 | Kurtz . | |
| 3,426,955 | 2/1969 | Olson . | |
| 3,768,719 | 10/1973 | Johnson . | |
| 4,565,315 | 1/1986 | Wagner et al. . | |
| 6,062,467 | 5/2000 | Ours et al. | 229/117.3 |

OTHER PUBLICATIONS

The Wiley Encyclopedia of Packaging Technology, Bakker, John Wiley & Sons. 1986.

*Primary Examiner*—Gary E. Elkins
*Attorney, Agent, or Firm*—Fulbright & Jaworski, LLP

[57] ABSTRACT

Dispensing assembly for a carton with a dispensing opening in a side wall thereof and a separate liner therein. The pour spout is pivotably mounted to the dispensing opening between an open and closed position and includes a front panel. The liner is bonded to the front panel so that when the front panel is initially opened, that portion of the liner bonded to said front panel separates from the rest of the liner, providing access to the interior thereof.

16 Claims, 21 Drawing Sheets

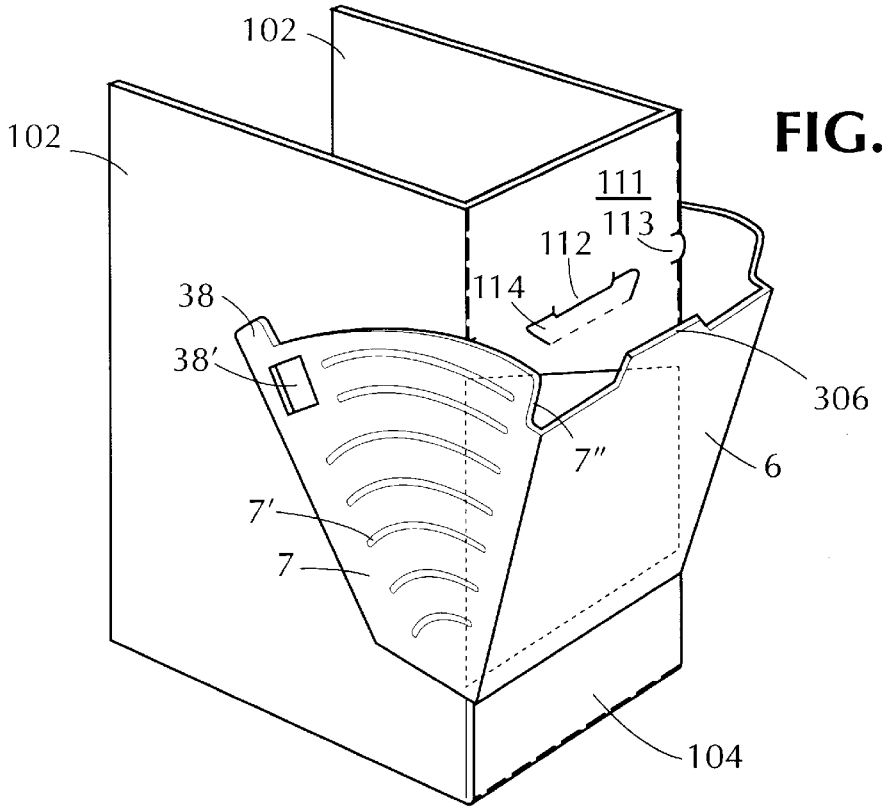
FIG. 3
FIG. 4
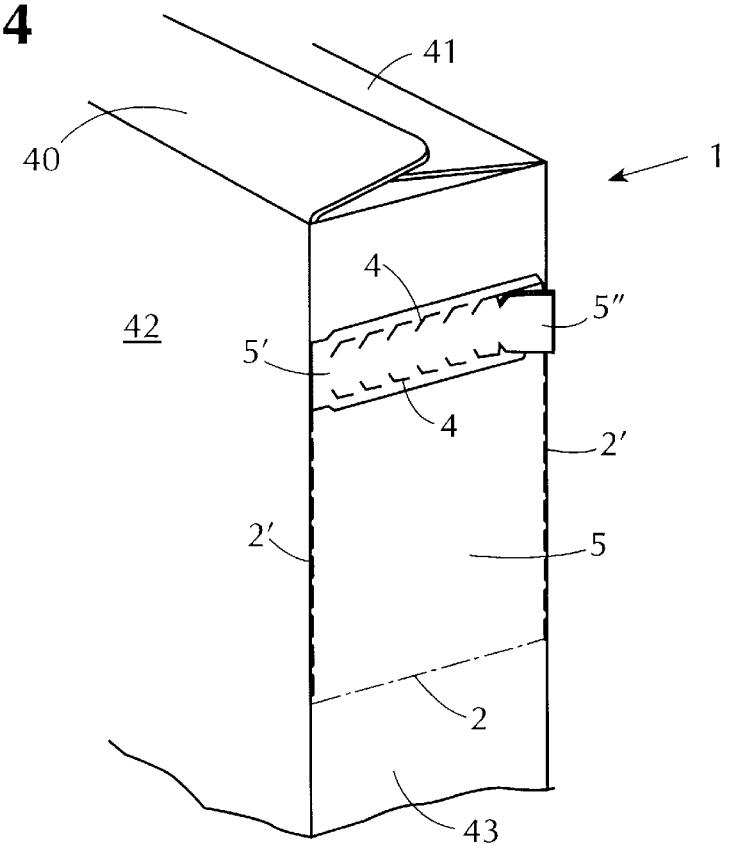

DISPENSING ASSEMBLY FOR A LINED CARTON AND PROCESS AND APPARATUS THEREOF

RELATED APPLICATION

This application claims priority from Provisional application Ser. No. 60/069,859 filed Dec. 17, 1997, and is a continuation in-part of application Ser. No. 09/050,533 filed Mar. 30, 1998, U.S. Pat. No. 6,062,467, both of which are incorporated herein by reference.

BACKGROUND

This invention relates to the packaging of dry particulate foods such as ready-to-eat ("RTE" ) cereal. More specifically, this invention relates to lined cartons with reclosable dispensing means connected to the liner in such a way that a portion thereof is separated from the liner upon initial opening to provide access to the contents of the carton.

The use of cartons with liner bags for dry particulate foods such as RTE cereal is well known. Such cartons are usually formed from a blank of paperboard or similar material comprising sidewalls and top and bottom flaps. The liner is a plastic or coated paper bag which holds the particulate food. The liner can be filled and sealed before or after being placed inside an open top carton, the top flaps of which are then folded and sealed.

Access to the contents of such cartons involves breaking the seal between the top flaps of the carton and pulling open the sealed liner bag. Resealing is often difficult and incomplete leading to a loss of freshness of the product. RTE cereal, for example, has a low moisture content and readily absorbs moisture from the air leading to a loss of crispness.

Dispensing devices such as pour spouts have been proposed to control the discharge of particulate product and minimize exposure to the atmosphere. However, when a carton with a pour spout contains a filled and sealed liner bag, the bag must be manually torn or cut with a knife or scissors when the spout if first opened. This arrangement has several drawbacks not the least of which is manually opening the liner bag. Once opened, and as the contents are depleted, the liner bag and its contents slide and shift positions in the carton which can cause the opened portion of the liner to become misaligned with the pour spout opening thereby hindering dispensing of product from the carton. This also causes product to drop between the carton and the liner.

SUMMARY OF THE INVENTION

The present invention is directed towards an improved food carton with a pivotable pour spout mounted to a dispensing opening. A front panel of the pour spout is bonded to a portion of the liner bag and, when initially opened, that portion partly separates from the rest of the liner thereby providing access to the contents of the carton. Thus, as the pour spout pivots to open for the first time, the liner bonded to the front panel separates to create an opening while remaining integral with the liner along the pivot axis.

Because the portion of the liner that separates corresponds to the size of the dispensing opening, reclosure of the pour spout fills the opening to minimize contact of the contents with the outside atmosphere. Moreover, the liner stays connected at the bottom of the dispensing opening to maintain alignment.

The liner can also be bonded adjacent the dispensing opening to further maintain alignment.

DESCRIPTION OF THE DRAWINGS

The present invention will be more fully understood from the following description and the accompanying drawings wherein:

FIG. 3 is a perspective view of the pour spout assembly of FIG. 2 shown folded and partly open.

FIG. 4 is a perspective view of a carton containing an end with access to a dispensing assembly of the invention.

DESCRIPTION

Figure 1:
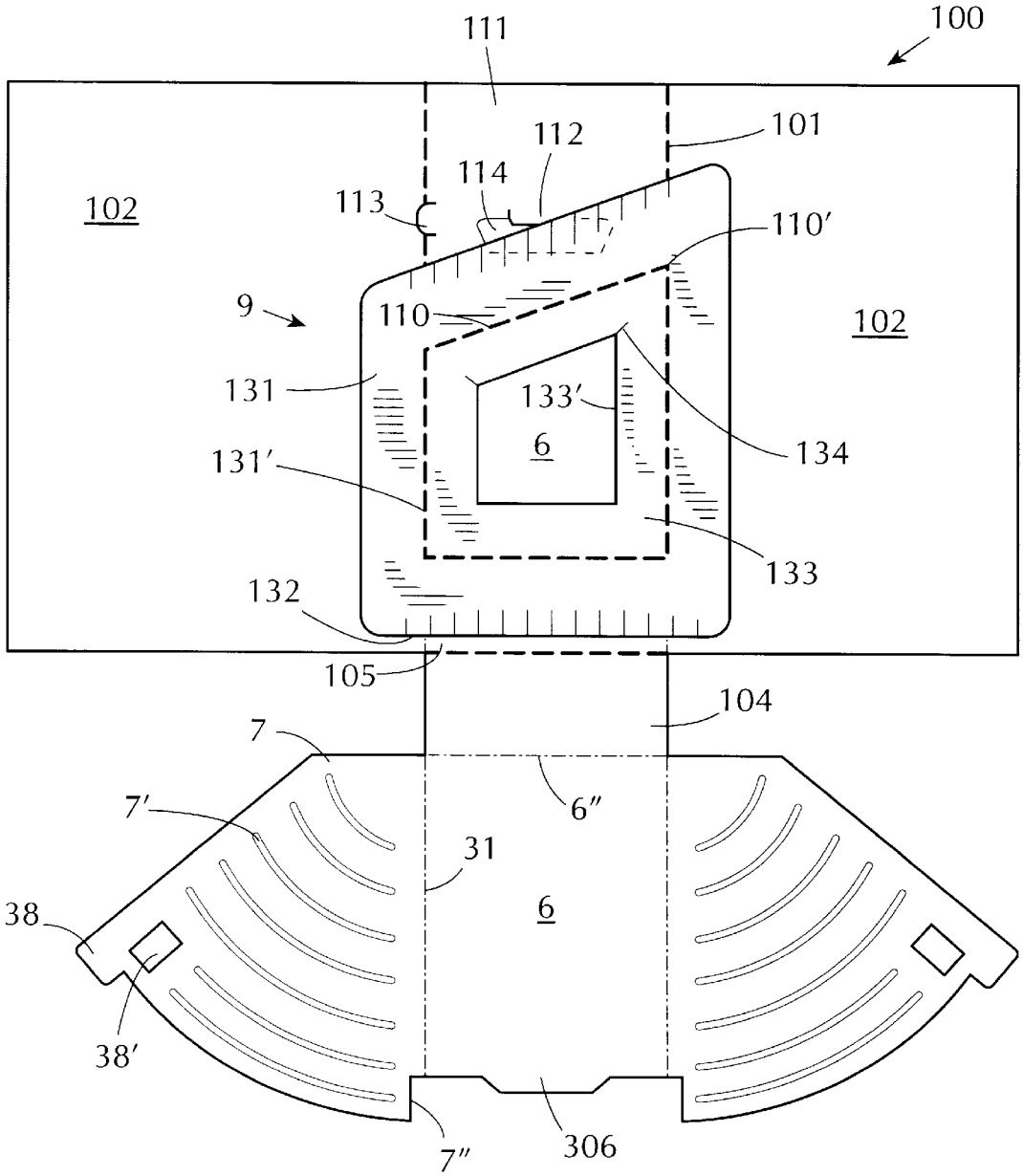
FIG. 1 is a plan view of a pour spout assembly of the invention opened up and laid flat.

Numerous carton and pour spout combinations are known. These include pour spouts attached to or integral with carton blanks. U.S. Pat. No. 5,012,959 is illustrative of the first type and shows a plastic pour spout fitment in a precut dispensing opening of a paperboard carton. The fitment is attached by an adhesive or a plurality of rivets.

Pour spout fitments may be made from any number of materials including, polyethylene, polypropylene, polystyrene, nylon ABS, paperboard and the like.

A carton blank with an integral pour spout is shown in U.S. Pat. No. 5,531,376.

It is preferred to use a conventional paperboard carton with a separate or integral pour spout and a conventional plastic liner bag that is filled and sealed before or after being inserted into an open top carton. Numerous apparatus and processes using such materials and techniques for packaging RTE cereal are known and available.

In carrying out the present invention, a portion of the liner bag is brought into contact and bonded with the front panel of a pour spout mounted in a dispensing opening in a side panel or end wall of the carton.

The preferred bonding medium is a hot melt adhesive. If the liner is in the carton, open and unfilled, simple means can be employed to clamp the liner and the front panel together and apply heat to heat seal to two surfaces together. Normally, in this embodiment, the hot melt adhesive is first applied in the desired pattern to the interior of the front panel of the pour spout.

If the liner is filled and sealed and already in a sealed carton, reduced pressure means such as a simple vacuum enclosure can be used to bring about sealing contact between the liner and the front panel of the pour spout.

An activatable hot melt adhesive is positioned in the desired pattern between the liner and the front panel and externally activated by delivering bonding energy to the interface such as by induction heating. This can be done by including a heat generating substance in or with the hot melt adhesive that will generate heat to activate the adhesive. Such substances include metal foils such as aluminum foil laminated on one or both sides to a hot melt adhesive, metal salts such as magnesium chloride, chromium nitrate, aluminum chloride and the like, mixed with a hot melt adhesive or metal particles such as iron or aluminum powder mixed with or flocked onto a hot melt adhesive applied in the desired pattern to the front panel.

When using magnetizable particles such as iron, a magnet can be employed to orient the particles and promote bonding with the liner. Metal salts and metal particles are used in amounts sufficient to activate the adhesive when external bonding energy is applied.

Hot-melt adhesives are 100% solids and are applied in hot, molten form. They set fast when heat is removed and can be preapplied and reactivated later by the application of heat. Hot melt adhesives are typically formulated with a backbone polymer such as ethylene-vinyl acetate or polyethylene. The main polymer is usually let down with a diluent such as wax to improve melt flow properties. Antioxidants are a component since the adhesive is applied hot and is subject to oxidation. Tackifiers improve hot tack and viscosity. Other materials influence melt temperature. Added colorants can make the adhesive more visible.

Hot-melt adhesives are readily available from numerous sources. INSTANT LOK® hot melt adhesives from National Starch and Chemical Corporation of Bridgewater N.J. 08807 are suitable for use in the invention.

Metal foil laminates are preferred for ease of application and activation. A typical metal foil laminate includes aluminum foil, generally vacuum metalized aluminum on a polyester film, with a linear low density polyethylene adhesive on one or both sides. Curwood Inc., of Oshkosh, Wis. 54903, provides CURLAM® Grade 5432 film with adhesive on one side. It is preferred to coat both sides of the film with an adhesive which enables the use of induction heating to bond the foil laminate to the front panel and the liner at the same time.

Induction heating equipment is widely used in the packaging field and suitable units for use in the invention are available from Lepel Corporation of Edgewood, N.Y. 11717 and Amertherm, Inc. of Scottsville, N.Y. 14546.

The intensity and duration of the induction field required to bond the liner to the front panel depends on the composition of the heat activatable adhesive. For example, an aluminum foil laminated with linear, low density polyethylene generally achieves its sealing temperature in 0.9 to 1.2 seconds when exposed to a Lepel, LEPAK, Jr. 750 watt induction sealer. An adhesive including a resin base with about 5 to 10 weight percent metallic salt, such as chromium nitrate or aluminum chloride, generally reaches its sealing temperature in under 2.0 seconds when placed in an 800 watt GE microwave oven operating at 900 to 1100 kHz.

Other induction heating systems and heat activatable adhesives can be adopted to the present invention. For example, an induction heating system for sealing packages using magnetic susceptible particles and heat softenable adhesives and high frequency alternating magnetic fields is disclosed in U.S. Pat. No. 3,879,247 which is incorporated herein by reference. Polymer systems for sealing containers which can be activated by electromagnetic energy frequencies of 0.1–30,000 MHZ, including radio frequency and microwave heating, are disclosed in U.S. Pat. No. 4,787,194 which is incorporated herein by reference. RF sealable, non-foil acrylate based polymers for packaging applications are disclosed in WO 95/03939 which is also incorporated herein by reference.

Heat sealing the liner to the front panel of the pour spout locally weakens the liner at the margins of the heat seal area which facilitates separation of a portion of the liner. This effect can be enhanced by attaching a laminate metal foil laminate to a raised area on the front panel with an overhang, that is, the size of the raised area is slight smaller than the area of the metal foil laminate. The edges of the foil laminate extend over the outside perimeter of the raised area and come in contact with the liner without contact with the front panel. When the foil is exposed to an induction field, the heat produced in the overhang area creates a thinned area or score line mirroring the shape of the overhang area.

In another embodiment, a fitment defining a dispensing opening is positional between the liner and the front panel of a pour spout. This provides a step-down around the periphery of the dispensing opening and consequently a weakened seal area which facilitates separation from the liner.

Other methods of scoring a liner include applying a metal containing substance, such as a metal foil or a metal ink, directly to the liner, and then exposing the liner to an induction field.

Referring now to FIGS. 4–6 and 13–15 of the drawing, the dispensing assembly of the invention, shown generally by reference numeral 3, is mounted to a dispensing opening in carton 1. Carton 1 includes side walls 42, end walls 43 and top flaps 40 and 41. Thee carton bottom is defined by similar flaps which are folded over and adhered to each other (not shown).

A sealed plastic liner bag 15 with particulate product such as RTE cereal is in carton 1. Access panel 5, which is perforated on three sides from end wall 43 so as to pivot around axis 2, carries the pour spout which includes front panel 6 and side panels 7.

Figure 13B:
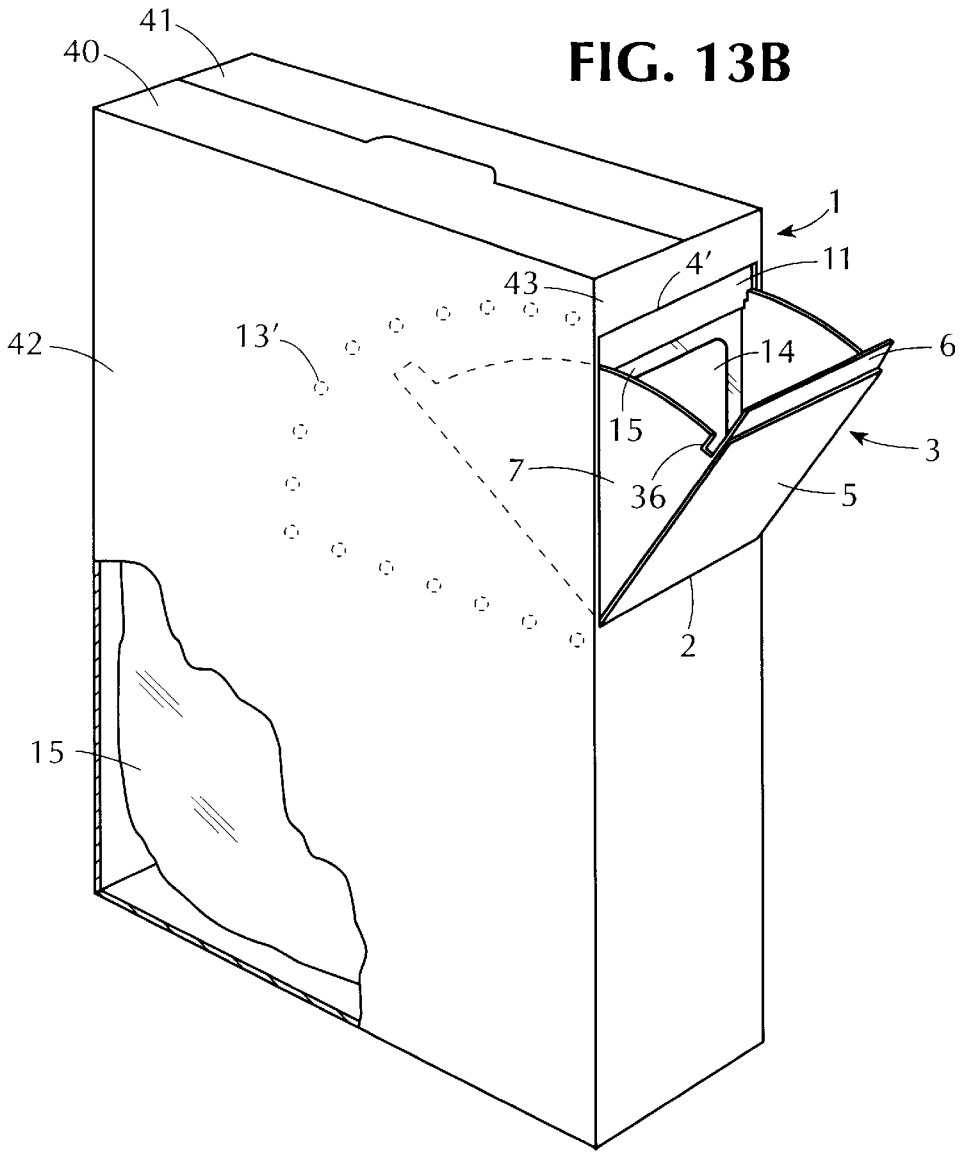
FIGS. 13A and 13C are side views and FIG. 13B is a perspective view of a dispensing assembly of the invention shown partly open.
Figure 13A:
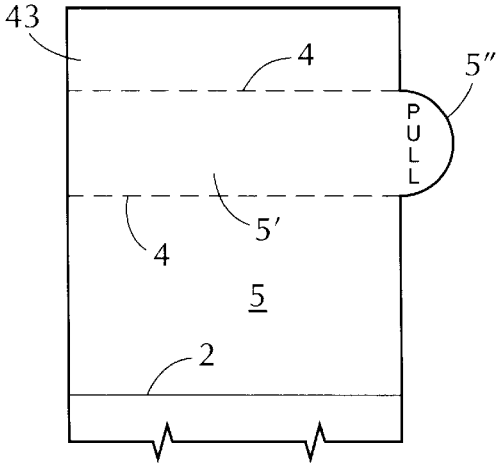
Figure 13C:
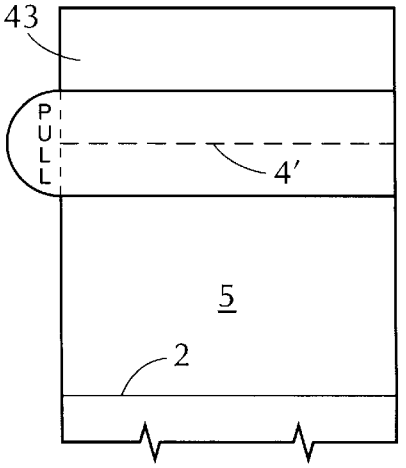

Access to pour spout 3 can be gained by removing strip 5 between perforated lines 4 via pull tab 5" thus exposing an upper portion of front panel 6 (FIGS. 4, 5, 13A and 13B). Alternatively, panel 5 can abut cut line 4' in end wall 43 (FIG. 13C). Line 4' is covered by a peal off tape which can be removed for initial opening of the pour spout 3.

Figure 2:
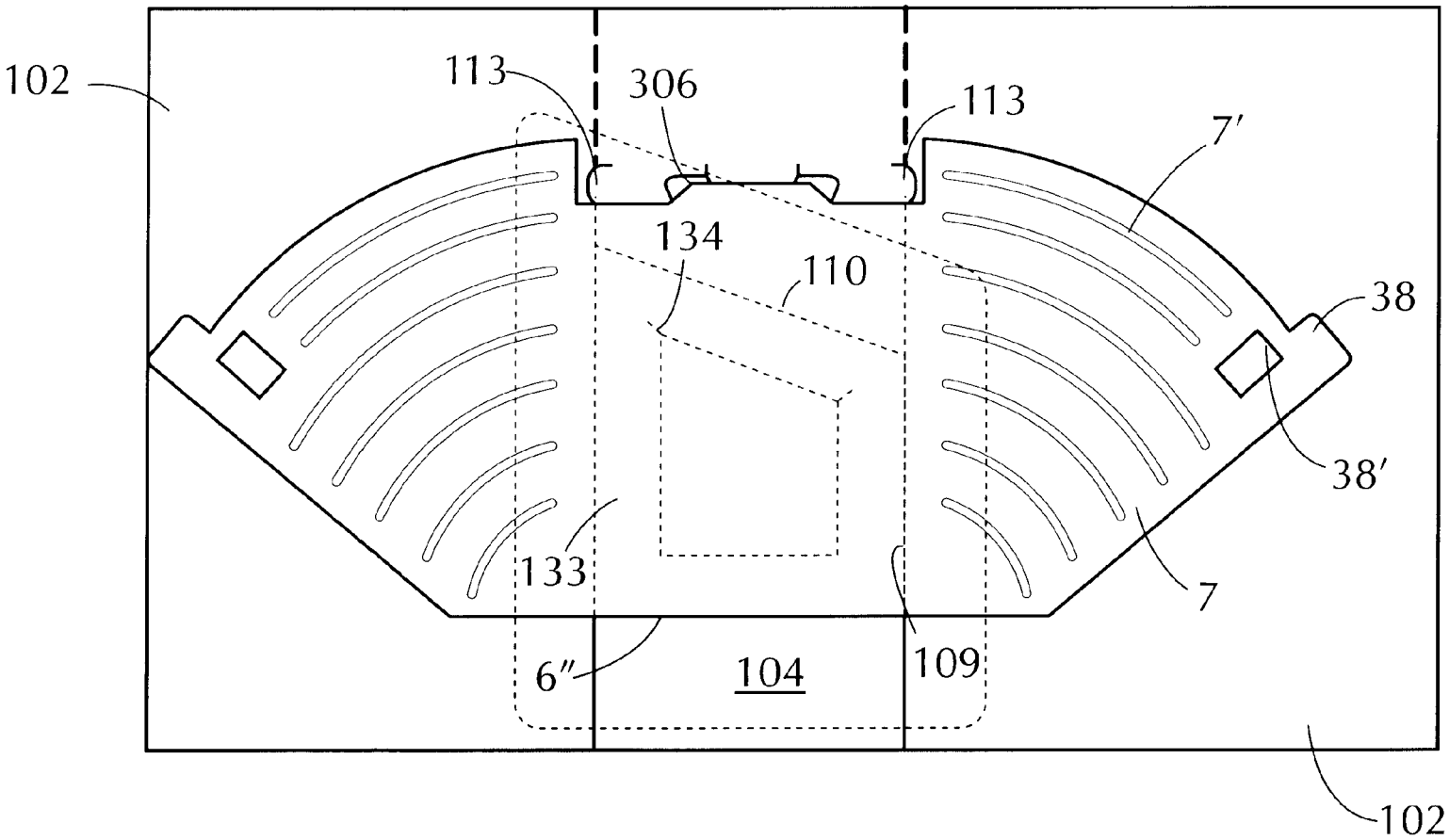
FIG. 2 is a plan view of the assembly of FIG. 2 turned over with the pour spout folded over a fitment which defines a dispensing opening shown in phantom.
Figure 5:
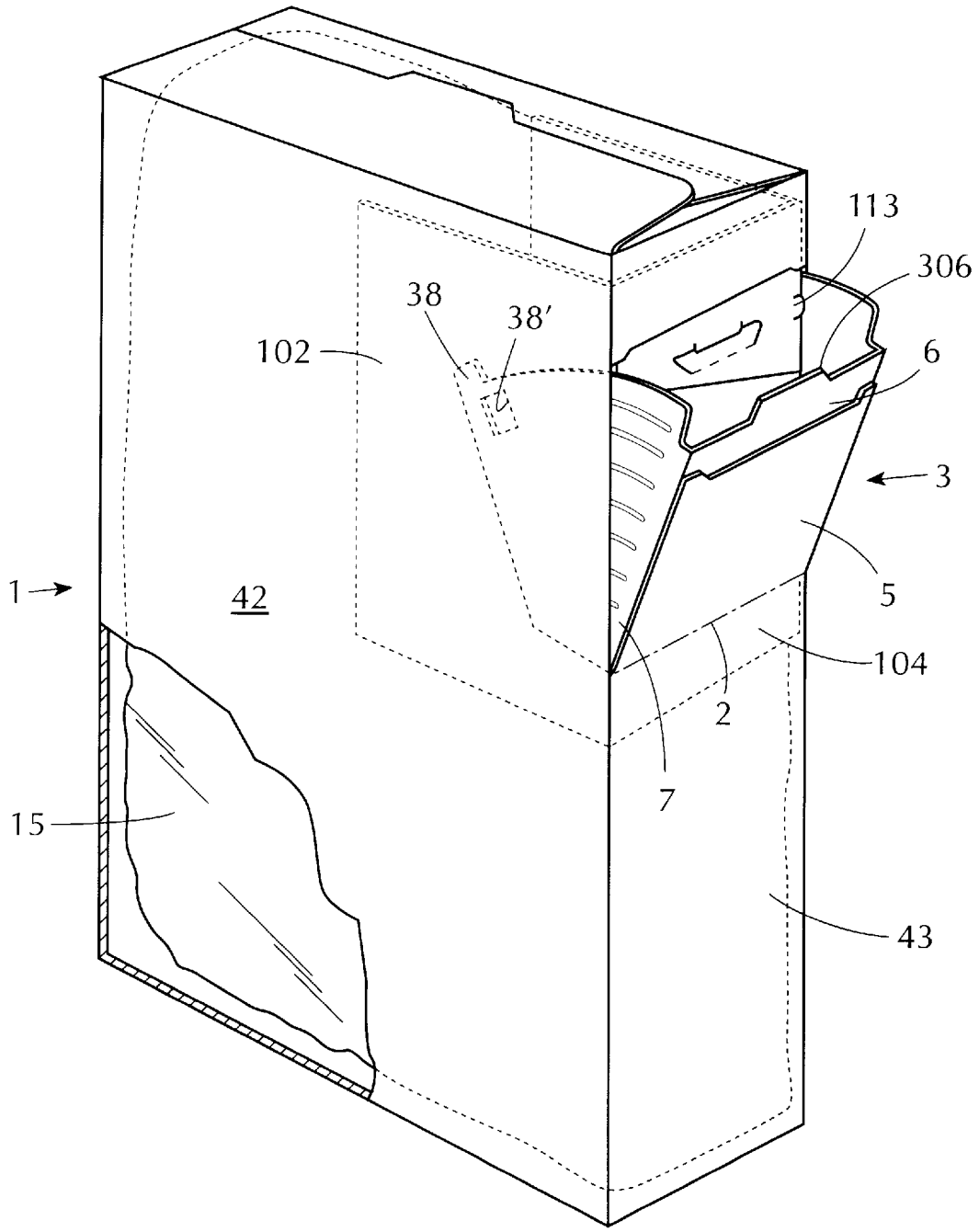
FIGS. 5 and 6 are perspective views of a dispensing assembly of the invention partly open and fully open.
Figure 6:
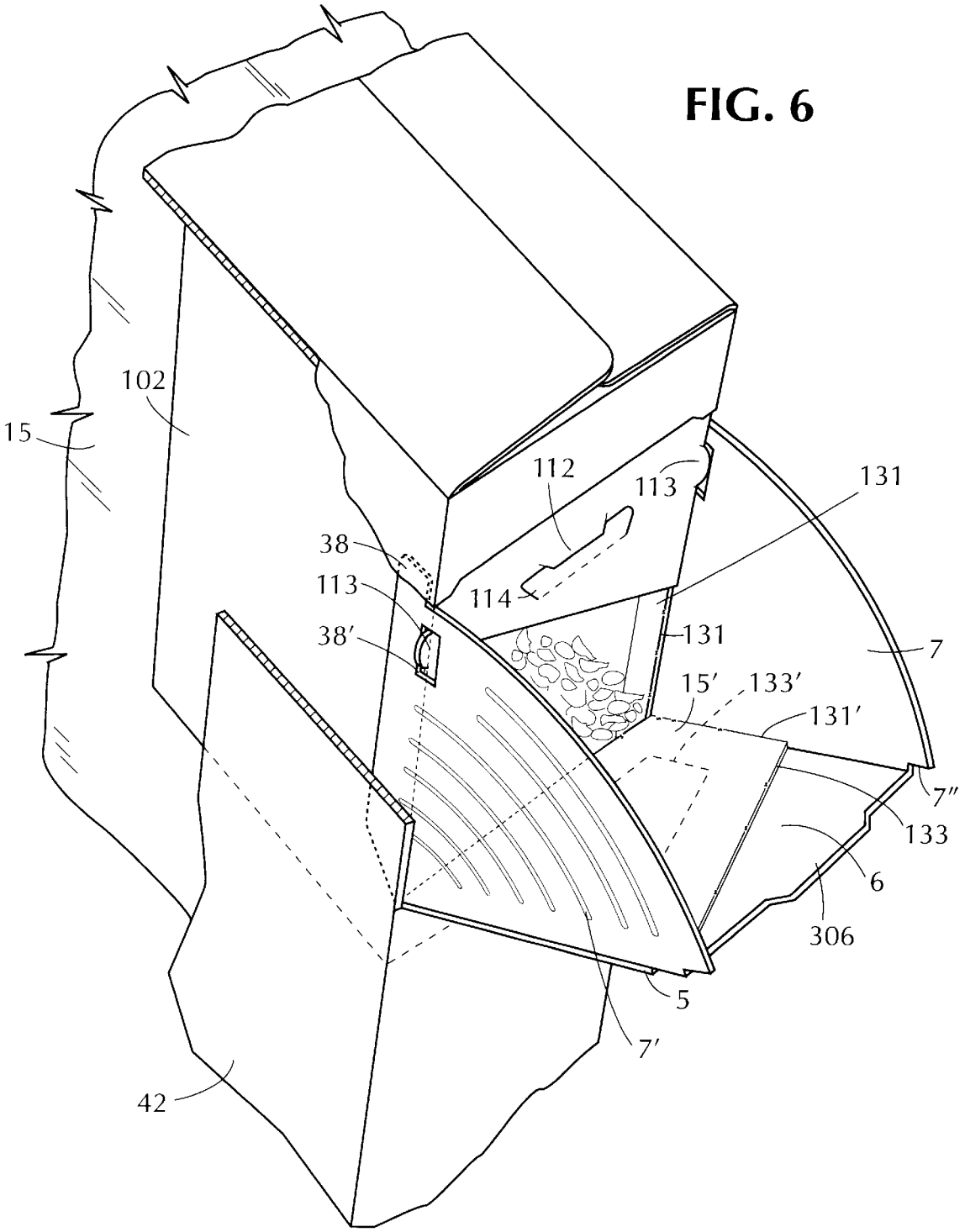

In the embodiment shown in FIGS. 1–3, the pour spout assembly has side panels 7 joined to front panel 6 along fold lines 31. Side panels 7 have stepped portions 7", ears 38 and cut-outs 38' for defining the open and closed positions of the pour spout. Side panels 7 have curved embossed areas 7' to stiffen or reinforce the panels 7 for closing the pour spout.

Front panel 6 in integral with fitment 100 via panel 104. Fitment 100 has upper and lower margin portions 111 and 105, respectively, and side members 102 which together define dispensing opening 109 shown in dotted lines under bonding member 9.

Front panel 6 has a tab 306 which releasably interlocks with tab 112 and panel 114 of upper margin portion 111 when spout panel 6 is folded over fitment 100 (FIG. 2).

Upper margin portion 111 has laterally extending flexible tabs 113 that interact with stepped portions 7" and cut-outs 38' to hold the spout in the open and closed positions. Ears 38 prevent pull-out of the spout. See FIGS. 5 and 6.

Figure 7:
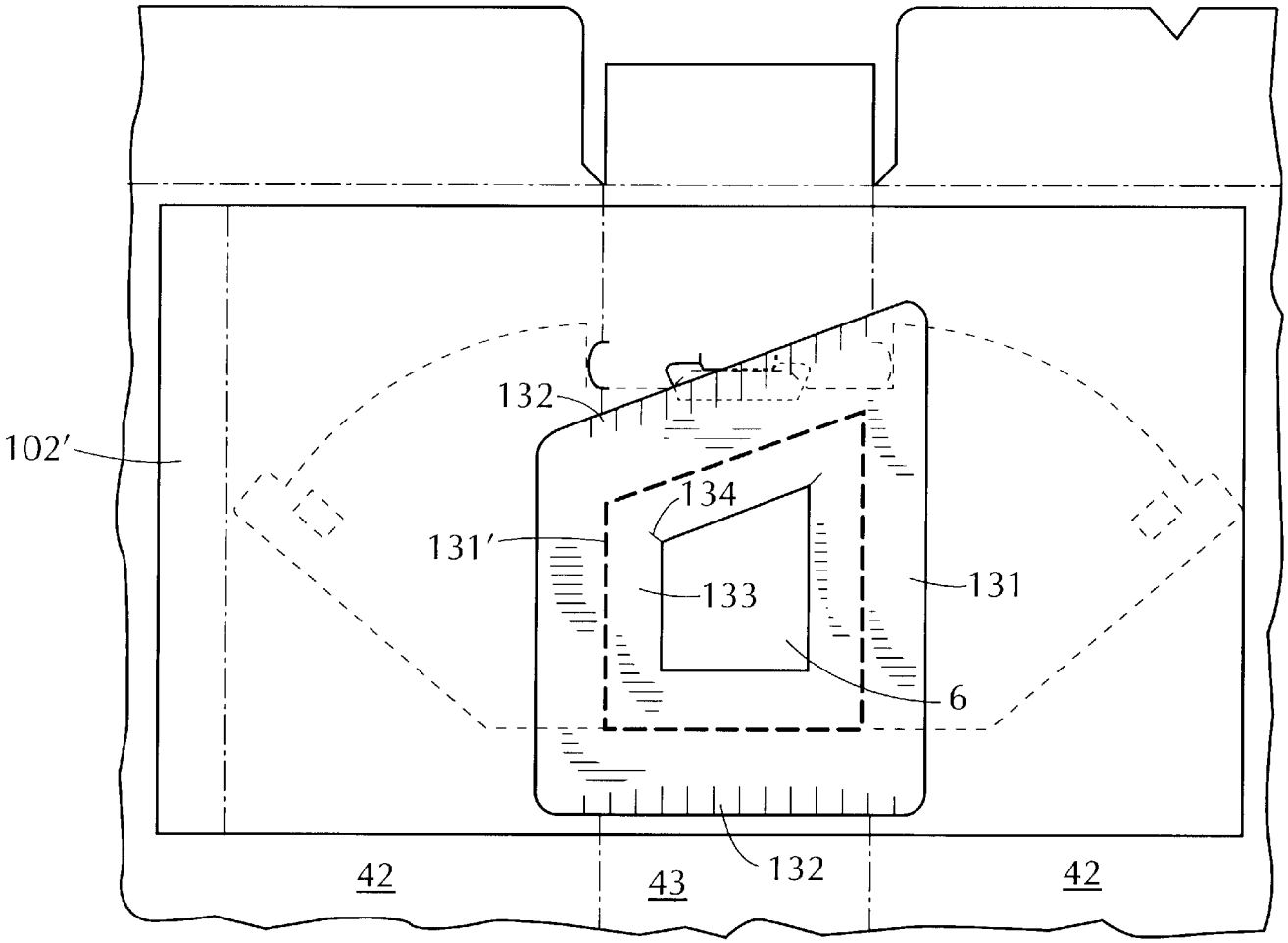
FIG. 7 is a plan view showing the assembly of FIG. 1 with the pour spout folded under a fitment (FIG. 2 turned over) and positioned on the interior of a flat carton blank.
Figure 8A:
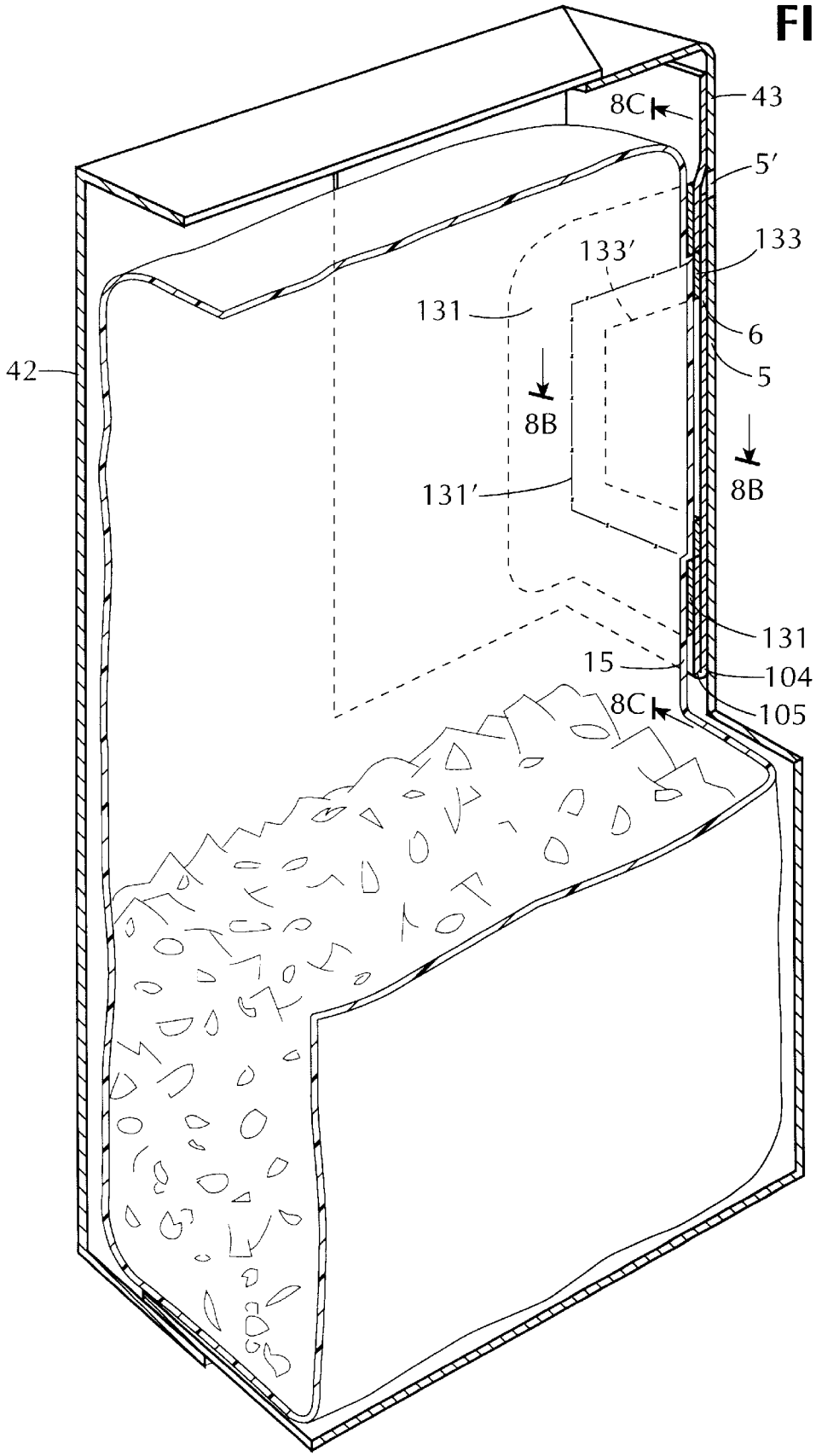
FIG. 8A is a perspective view, broken away, of the interior of a dispensing assembly of the invention.
Figure 8B:
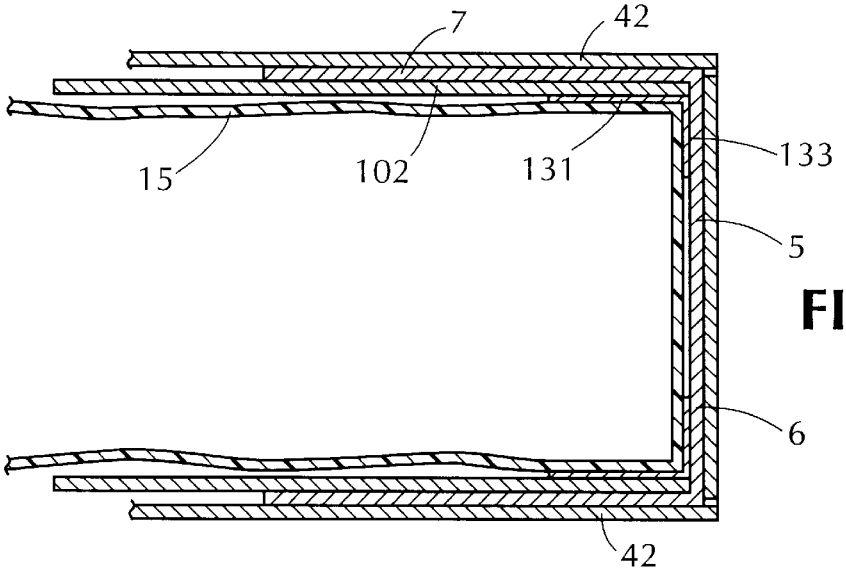
FIGS. 8B and 8C are cross-sectioned views taken along lines 8B—8B and 8C—8C of FIG. 8A.
Figure 8C:
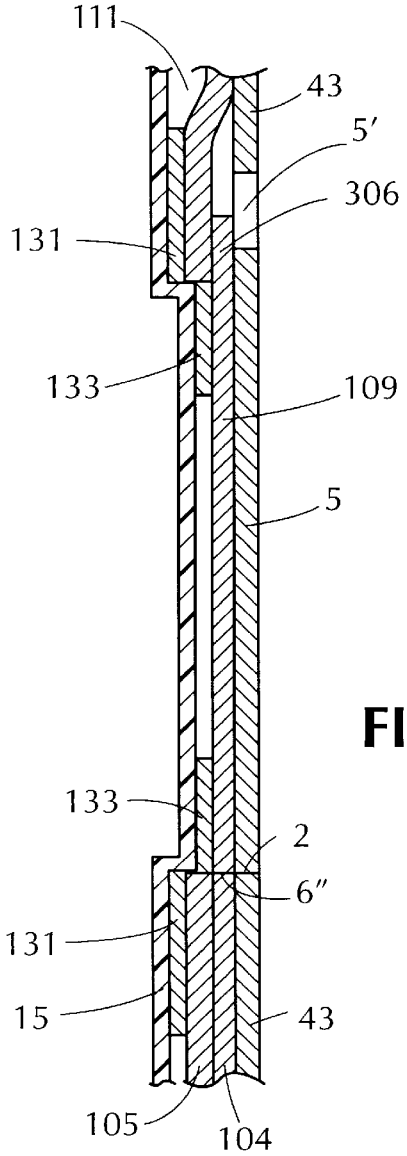
Figure 10:
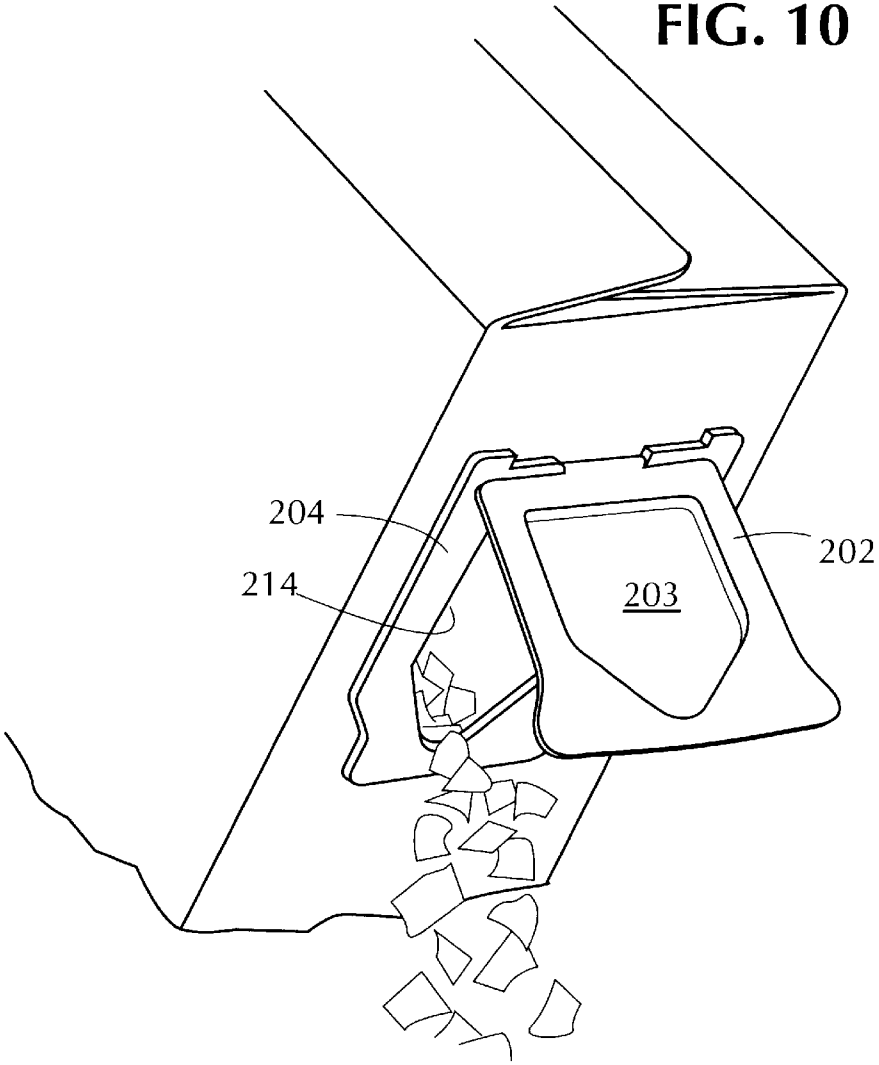
FIGS. 9 and 10 are perspective views of an alternate dispensing assembly show closed and open.
Figure 9:
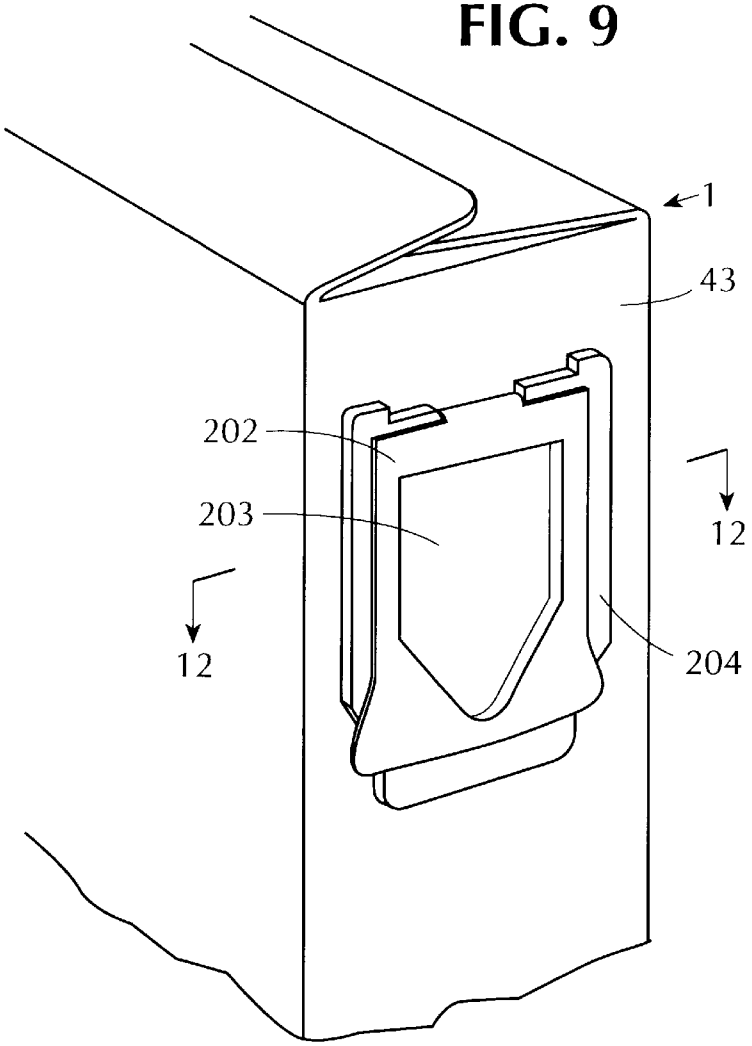
Figure 12:
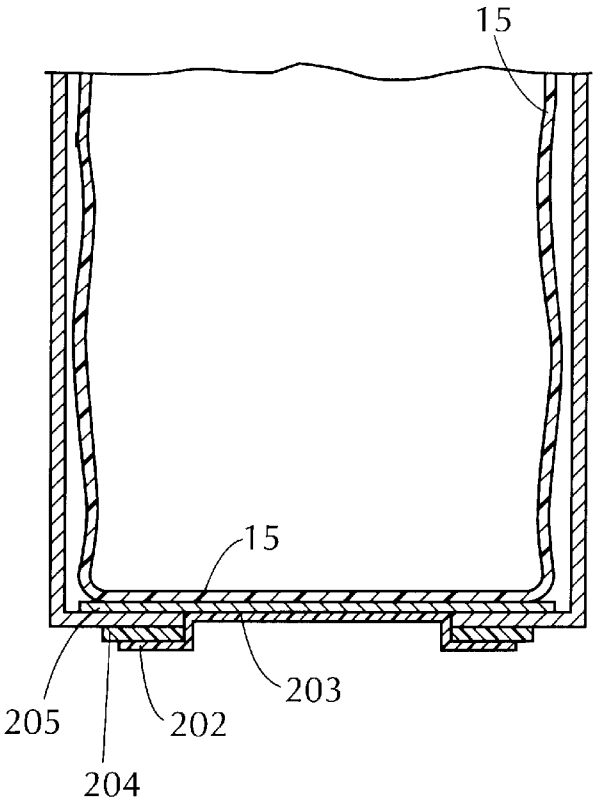
FIG. 12 is a cross-sectional view taken along line 12—12 of FIG. 9.
Figure 11:
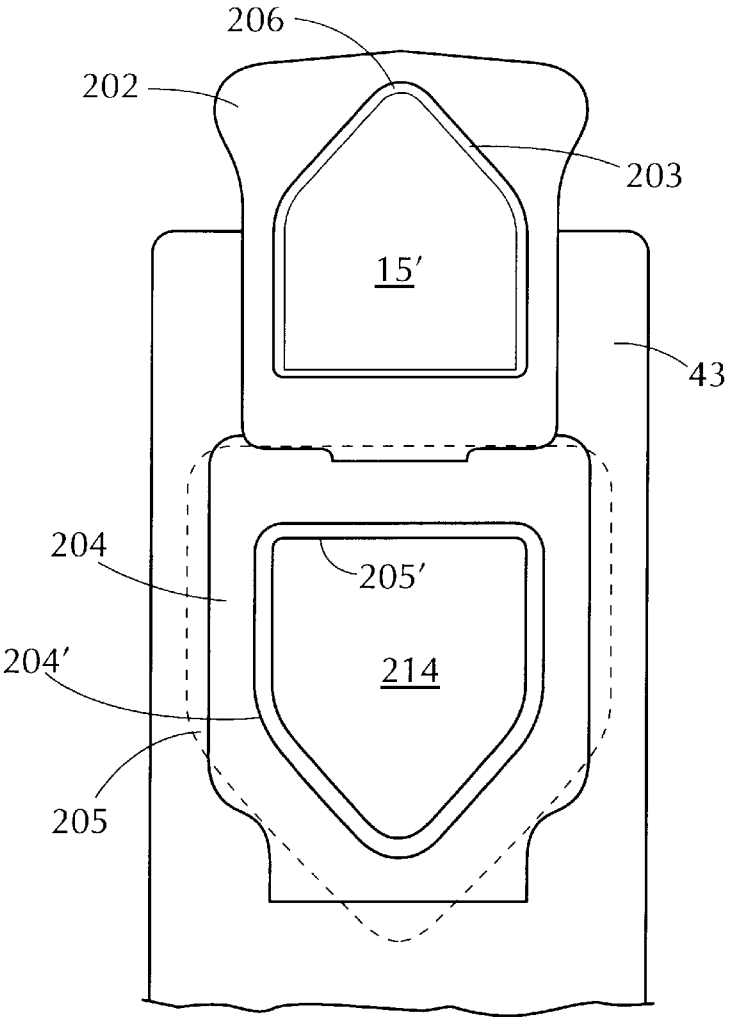
FIG. 11 is a front view of the assembly of FIGS. 9 and 10 shown fully open.

When the pour spout is folded over fitment 100 (FIG. 2), connecting panel 104 ties on top of lower margin portion 105 and front panel 6 covers dispensing opening 109 (shown in dotted lines) and pivots at line 6" which is aligned with the bottom of opening 109. The pour spout and fitment can be spot or hard glued to the interior of carton end wall 43 via upper portion 111 and connecting panel 104 (FIGS. 7 and 8*c*). One side member 102 can be wider to provide an area 102' (FIG. 7) to spot or hard glue to the interior of carton side 42.

The top of opening 109 is sloped along line 110 such that the higher corner 110' provides an area of reduced resistance to initiate separation of the liner bonded to front panel 6 from liner 15 itself.

Bonding member 9 (FIGS. 1 and 2) is a metal foil laminate having an outer member 131 adhered or spot glued to margin portions 111 and 105 and side members 102 so as to surround opening 109.

Inner member 133 corresponds to opening 109 and is connected to outer member 131 via perforation line 131' about the periphery of opening 109. Inner member 133 is adhered or spot glued to front panel 6 (FIGS. 1 and 2).

Inner member 133 has a central cut-out to conserve material and corner cuts 134 to concentrate heat for bonding liner 15 to panel 6 around the periphery of opening 109. This creates a weakened seal line corresponding to line 131' to facilitate initial opening of the pour spout, especially at corner 110'. The step-down between opening 109 in fitment 100 and front panel 6 also contributes to the formation of a weakened seal line.

Outer member 131 has a series of graduated fingers 132 which help to distribute bonding heat over the area of member 131 to prevent the formation of weak spots when liner 15 is bonded to the area surrounding opening 109 to maintain alignment of the liner with the pour spout.

In an alternate embodiment shown in FIGS. 13–17, side panels 7 have notches 36 and 37 for defining the closed and open position of the spout 3 as well as tabs 38 which prevent complete removal of the pour spout in the event the position defined by notches 37 is exceeded.

Figure 15A:
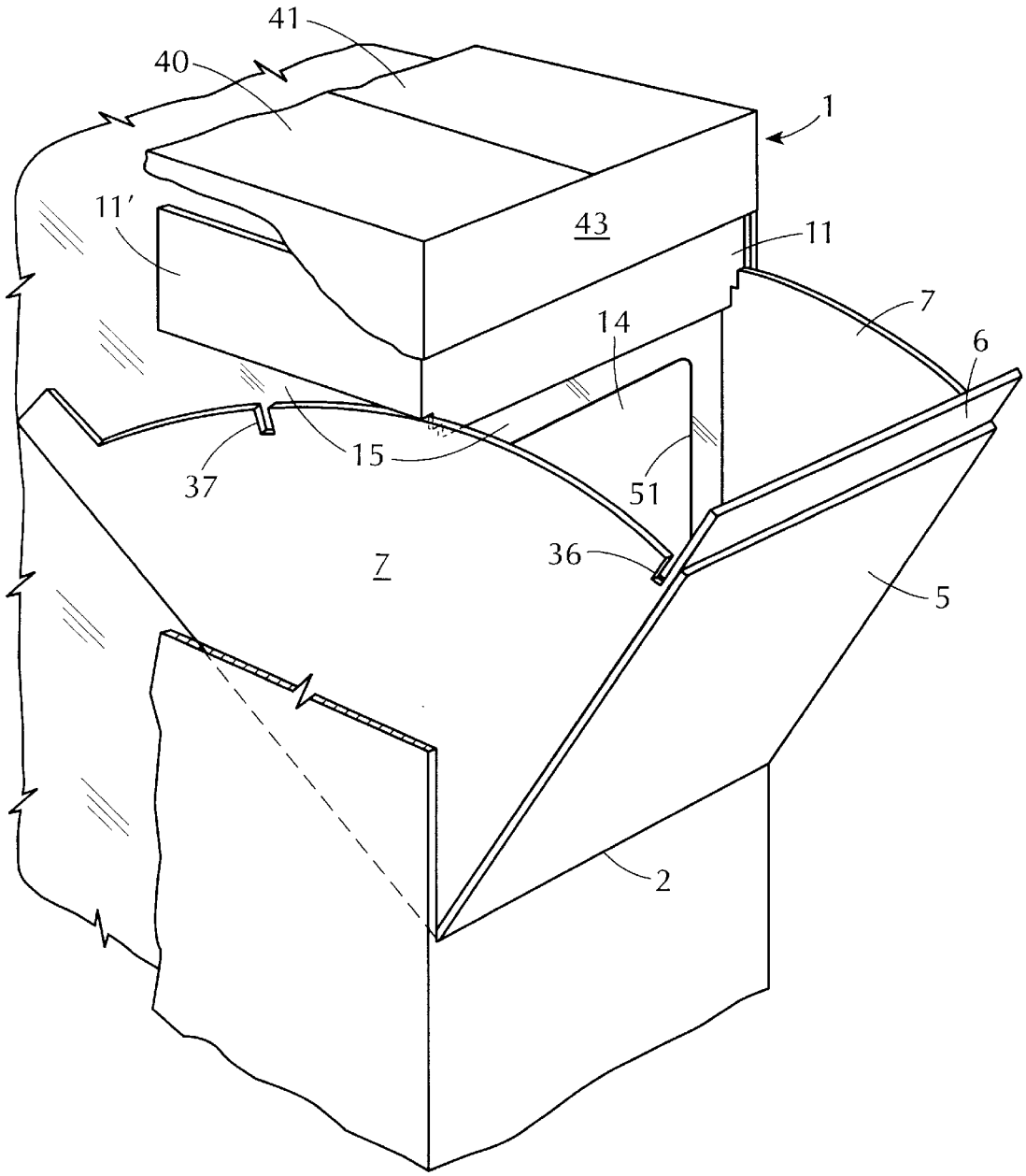
FIGS. 15A and B are perspective views, partly broken away, showing a dispensing assembly partly open and fully open.
Figure 18:
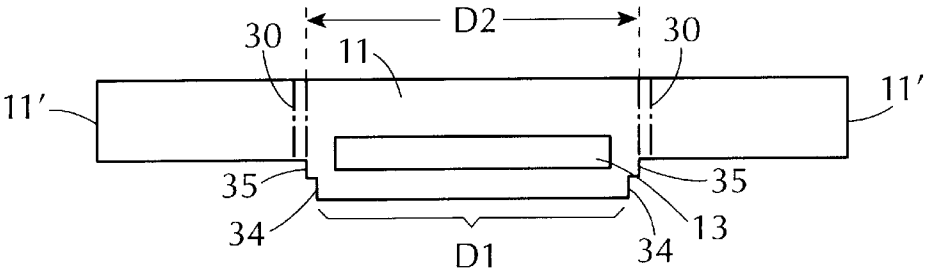
FIG. 18 is a plan view of a top insert laid flat with its interior surface facing upward.

In this embodiment, with reference to FIG. 18, the pour spout incorporates an upper member having a center section 11 and side members 11' which fold along fold lines 30. Center section 11 and side members 11' are adhered to the interior of side and end walls 42 and 43 with center section 11 positioned as shown in FIGS. 13B and 15A such that the upper portion of front panel 6 covers section 11 and terminates at line 4' in end wall 43.

Center section 11 has two step down sections which interact with the side panels 7 and notches 36 and 37. The first step down section has detents or ends 34 and a width D1 which corresponds to width D1 of front panel 6. The second step down member has similar detents or ends 35 and a width D2 which is slightly larger than D1, the width of front panel 6, and thus slightly larger than the width of end wall 43. This provides a snap fit for opening and closing the pour assembly 3. When partly open as shown in FIG. 15A, side panels 7 pivot between side walls 42 and ends 35 of center section 11. As the front panel 6 pivots to an open position, ends 35 enter notches 37 because the distance D2 between ends 35, being greater than width D2 of panel 6, is also greater than the distance between notches 37. In the open position, side panels 7 now rest against ends 34 of section 11 to keep them approximately parallel to side walls 42.

Figure 15E:
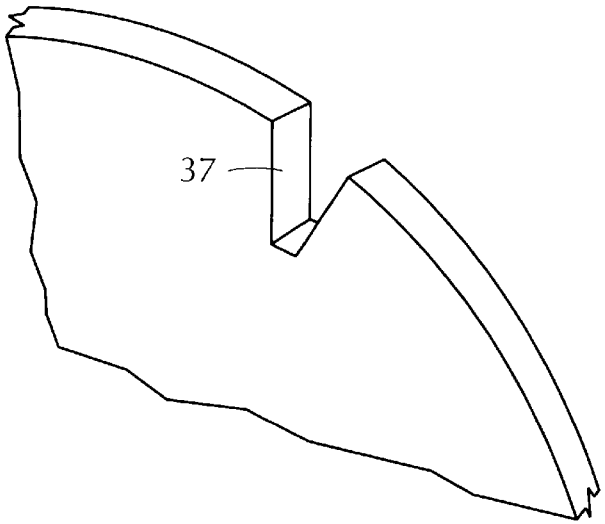
FIG. 15E is a perspective view of an alternate notch shape.
Figure 15B:
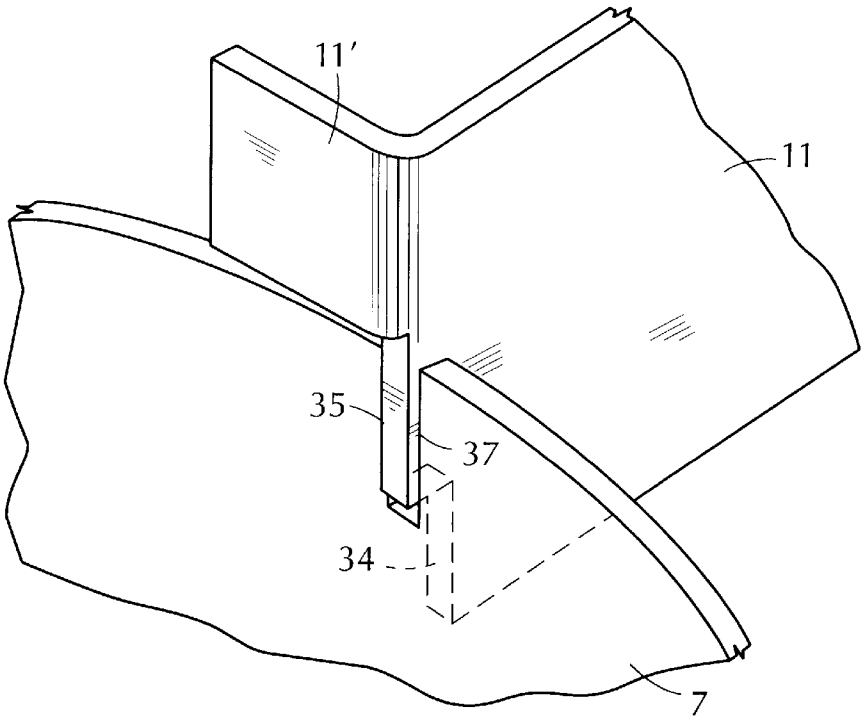
FIGS. 15C and D are partial cross-sectional views showing a dispensing opening partly open and fully closed.
Figure 15D:
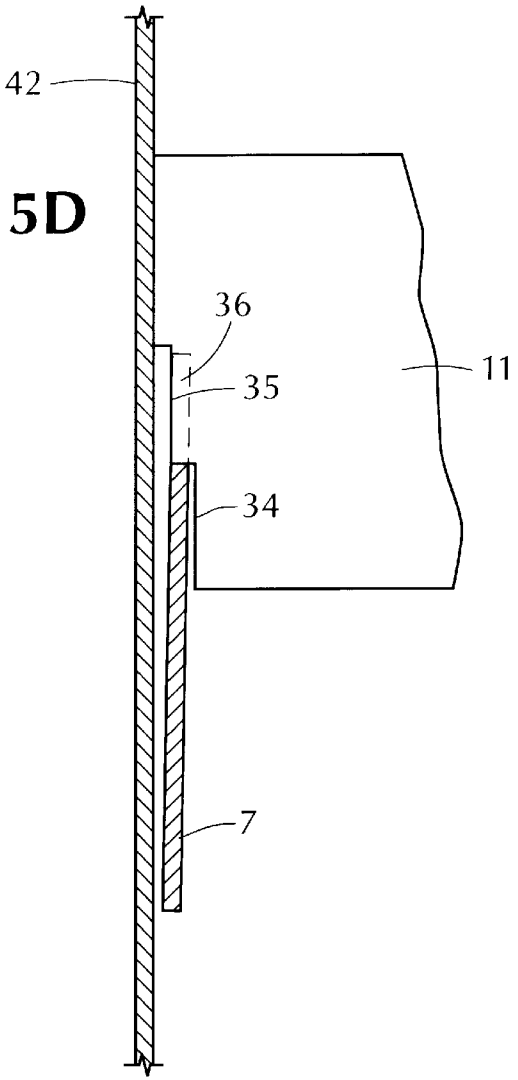
Figure 15C:
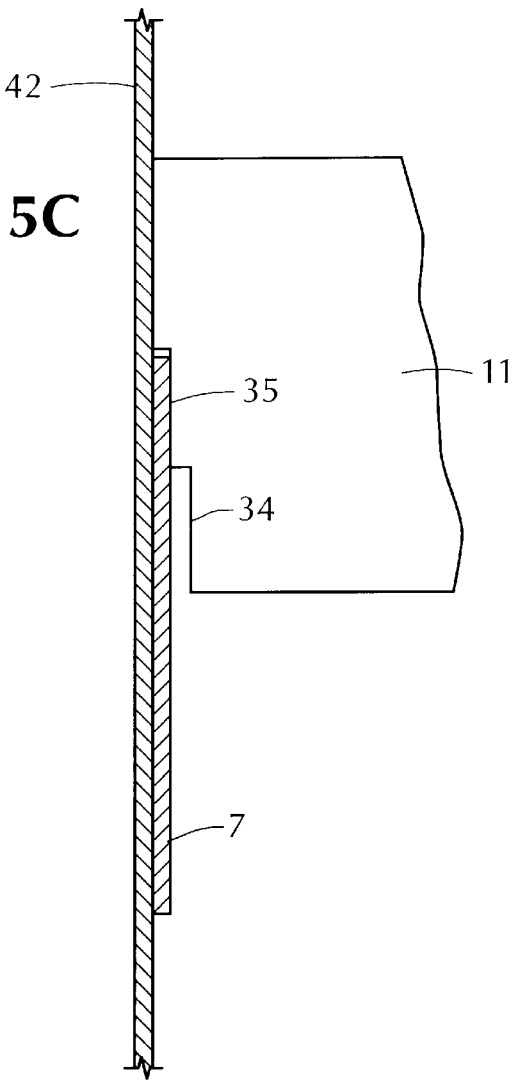

When the pour spout is closed, ends 35 enter notches 36 with adjacent portions of side panels 7 again resting against ends 34 (FIG. 15D). This provides a snap like opening and closing by virtue of the greater distance between ends 35 and notches 37 in the open position and notches 36 in the closed position.

FIG. 15E shows an alternate V shaped configuration for notch 37 in side walls 7 to facilitate opening and closing of the pour spout 3.

Figure 14:
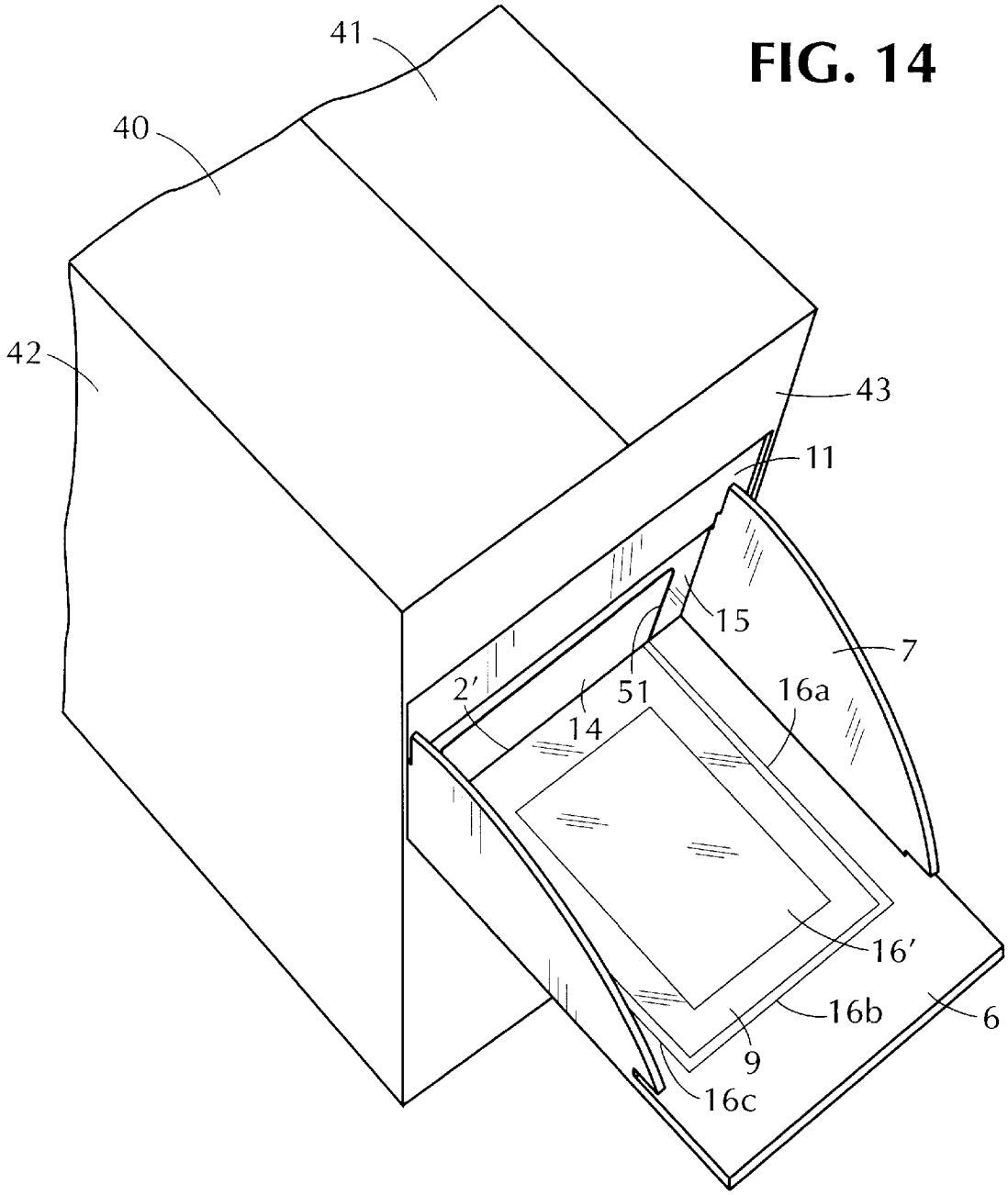
FIG. 14 is a perspective view of a dispensing assembly of a invention shown fully open.

As shown in FIGS. 1, 7 and 14, foil laminate 9 promotes bonding to liner bag 15. In FIGS. 1 and 7, inner member 133 promotes bonding to front panel 6 and outer member 131 promotes bonding to the area surrounding dispensing opening 109. In the embodiment of FIG. 18, member 13 bonds liner 15 to end wall 43 above the pour spout and is positioned on center section 11 facing the interior of the carton.

Figure 17:
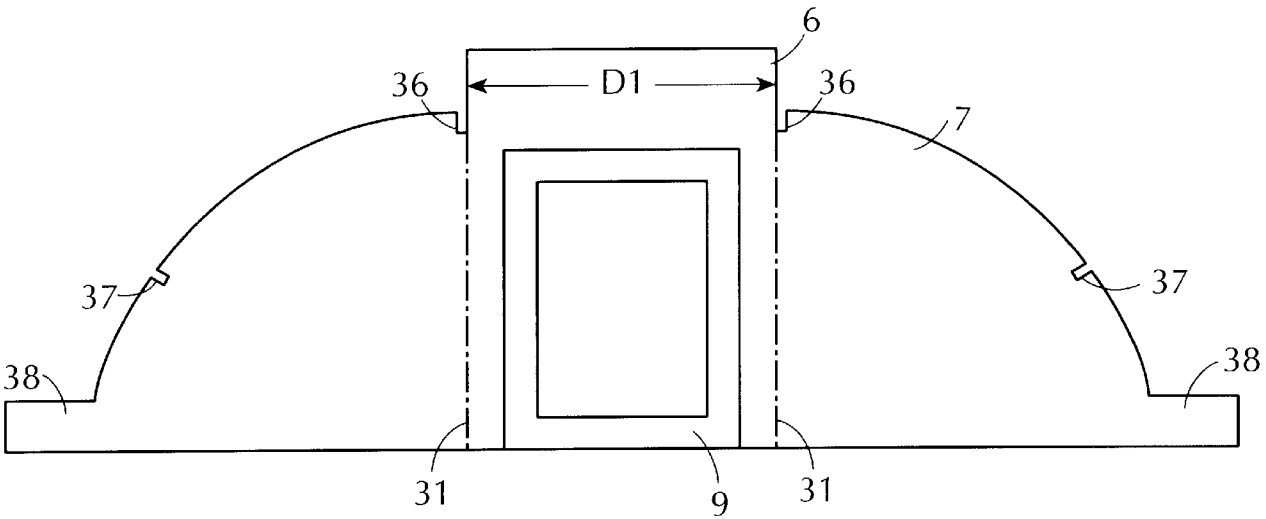
FIG. 17 is a plan view of a pour spout assembly laid flat with its interior surfaces facing upwards.

Bonding member 9 is shown in FIG. 17 to have a generally rectangular shape which defines that portion of liner bag 15 that separates from the liner as the pour spout pivots to open for the first time. In FIG. 7, inner member 133 corresponds to opening 109 and defines the portion of liner 15 that separates upon initial opening.

Figure 16B:
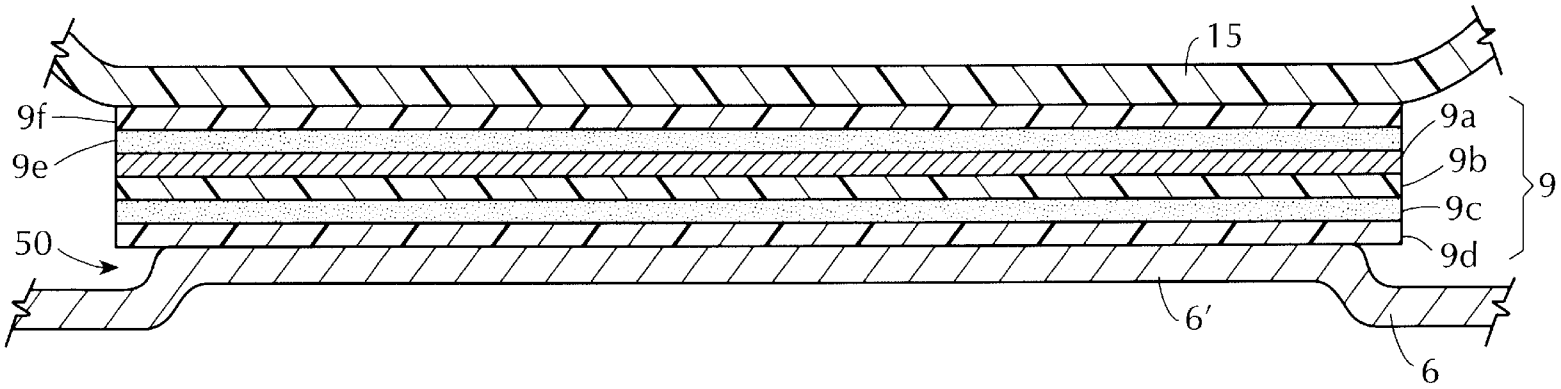
FIG. 16A is a plan view of the interior of a front panel of a dispensing assembly and FIGS. 16B–E are cross-section views showing means to promote bonding between the front panel and the liner.

As shown in FIG. 16B, member 9 includes a layer of metal foil 9*a* such as aluminum foil or vacuum metalized aluminum adhered to polyester layer 9*b*. Adhesive layers 9*c* and 9*e* flank both sides of the polyester/foil laminate. Linear low density polyethylene adhesive layers define the outermost layers 9*d* and 9*f*. The overall thickness of member 9 is about 5 mils. Inner and outer members 131 and 133 (FIGS. 1 and 7) are of the same or similar construction as member 9 of FIG. 16B.

In the embodiment shown in FIGS. 17 and 18, bonding member 9 is adhered (initially by spot gluing) to raised portion 6' of front panel 6 which corresponds approximately to the rectangular shape of member 9. Bonding member 13 is of a similar construction as member 9 and can also be spot glued in the position shown in FIG. 18. Spot glueing of members 9 and 13 is preferred so as to activate both adhesive layers 9*d* and 9*f* at the same time as described below. The same applies to outer member 131 and inner member 133 (FIGS. 1 and 7).

As shown in FIG. 16B, foil laminate 9 overlaps the edges of raised area 6' leaving air gaps 50.

Figure 19:
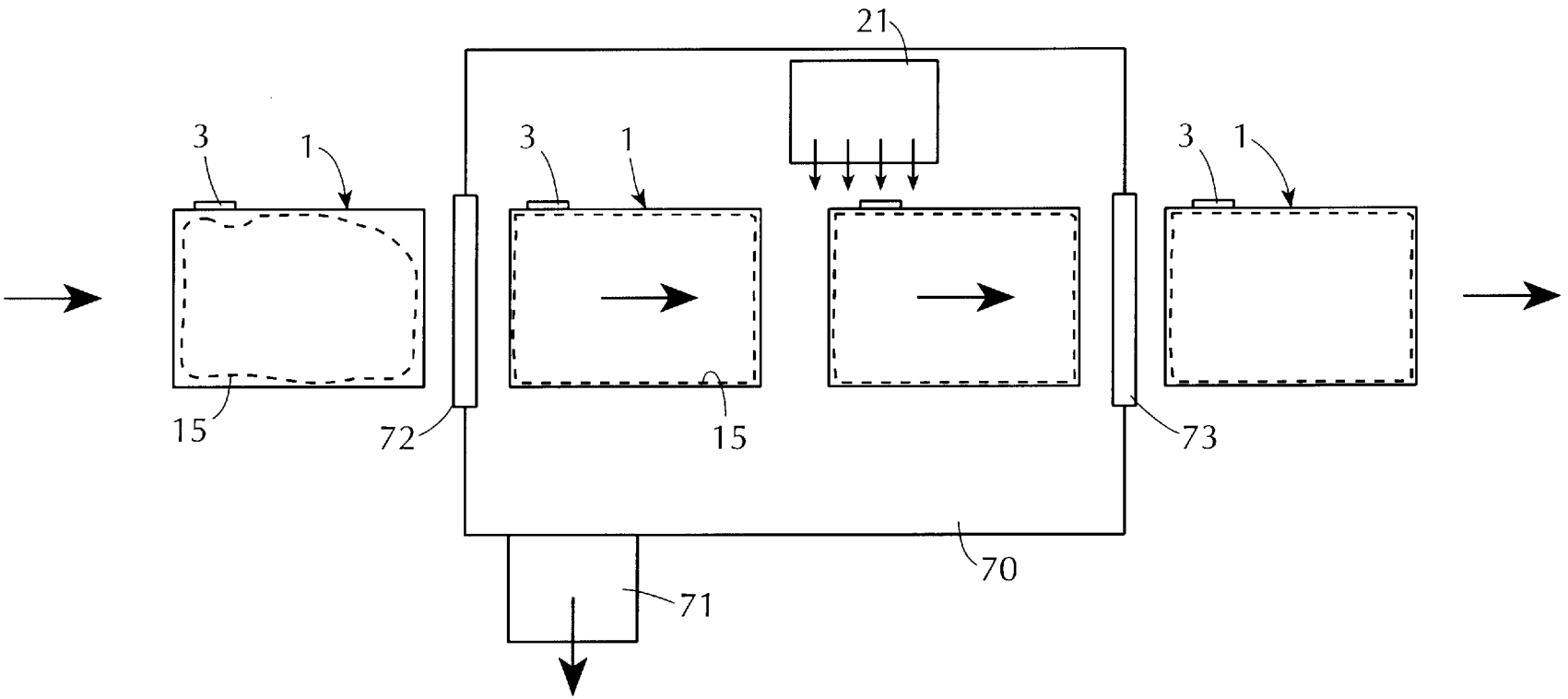
FIG. 19 is a diagrammatic view of apparatus for sealing the liner to the pour spout assembly.

In order to bring liner bag 15 into contact with pour spout 3, referring to FIG. 19, a filled carton is passed through enclosure 70 via air locks 72 and 73 which maintain an area of reduced pressure in enclosure 70 via vacuum generator 71. Because sealed liner bag 15 contains atmospheric air, the application of a vacuum has the effect of inflating liner bag 15 forcing it tightly against the interior of the carton and the pour spout assembly. See, for example, FIG. 8C. While in this state, the carton 1 enters a heating zone provided with an induction heating device 21. A suitable induction heater is a Model XP20 made by Ameritherm Inc.

Figure 16C:
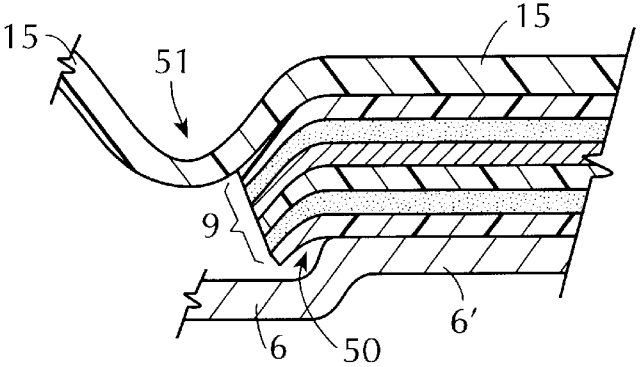
Figure 16A:
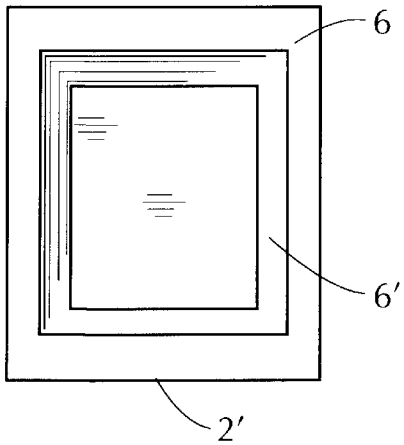

In the embodiment of FIGS. 1–7, heat delivered via induction heater 21 heats inner and outer members 131 and 133 which in turn actuates adhesive layers corresponding to layers 9*d* and 9*f* of FIG. 16B. In the embodiment of FIG. 16A–C, induction heat provided by member 21 heats the metal foil laminate member 9 which in turn activates adhesive layers 9*d* and 9*f*. Adhesive layer 9*d* adheres the foil laminate member 9 to raised area 6' of front panel 6 while adhesive layer 9*e* adheres the plastic liner bag 15 to the front panel 6 in an area defined by the rectangular shape of metal foil laminate member 9. Because member 9 overlaps raised area 6' leaving air spaces 50, (FIG. 16C) heat generated by foil layer 9*a* becomes concentrated at the edges of the member 9 in the area of overhang which stretches and thins the bag liner 15 in the area shown by reference numeral 51. This thinning provides a score line in the bag liner 15 around the edges of member 9 to facilitate initial opening of the pour spout. When liner 15 is forced into contact with member 9 under vacuum, tension is created which results in a stretching effect along the overhanging edges of metal foil laminate member 9. The application of heat while in a stretched state results in an area of reduced thickness and an easily rapturable score line around the outside edges of member 9. The same is true in the case of the step down between opening 109 of fitment 100 and front panel 6 (FIG. 8C).

To open the pour spout of FIGS. 1–7, tab 5" is pulled to remove section 5'. This exposes tab 306 of front panel 6 which extends above access panel 5. Insertion of one or more fingers behind tab 306 will cause the liner to begin to tear at corner 110' and then along line 110. Continued pulling separates panel 5 along lines 2' and the liner along line 131' in an area corresponding to dispensing opening 109 and inner member 133.

In a preferred embodiment, spout side panels 7 pivot in and out between a narrow space defined by side members 102 and carton side walls 42 without coming into contact with liner 15.

Upon closing of the spout, tab 306 interlocks with members 112 and 114 providing a "snap" closure to insure freshness. The severed portion of liner 15, adhered to front panel 6 in an area corresponding to inner member 133, is still attached along pivot line 2 to the liner itself and fits neatly into the severed opening which is an exact alignment by virtue of liner 15 being sealed around opening 109 via outer member 131.

Upon initial opening of the pour spout of FIGS. 13–18, portion 16 of liner bag 15 remains bonded to panel 6 via member 9 and separates on three sides 16*a*, 16*b* and 16*c* corresponding to the thinned or weakened score line formed in the area of 51 around the edges of the member 9. Thus, as the open position is reached, portion 16 of liner bag 15 separates from the main body of the liner bag but remains integral therewith along the pivot axis 2'. Upon reclosing the pour spout, side panels 7 cooperate with ends 34 and 35 on member 11 to maintain alignment between portion 16 and opening 14 in the liner bag 15. To help maintain alignment of the liner bag opening 14 with the pour spout assembly, metal foil laminate member 13 is positioned as shown in FIG. 18 to bond the liner bag adjacent the opening 14 above the opening formed by the dispensing assembly itself. Further alignment means can be provided by a series of dots or circles 13' (FIG. 13B) of the same metal foil laminate as member 9 positioned on side panels 42 adjacent the periphery of the side panels 7 when the pour spout is in a closed position. Members 13 and 13' bond the liner bag 15 to the carton walls via induction heating at the same time member 9 bonds the liner bag to front panel 6 (FIG. 19).

Figure 16D:
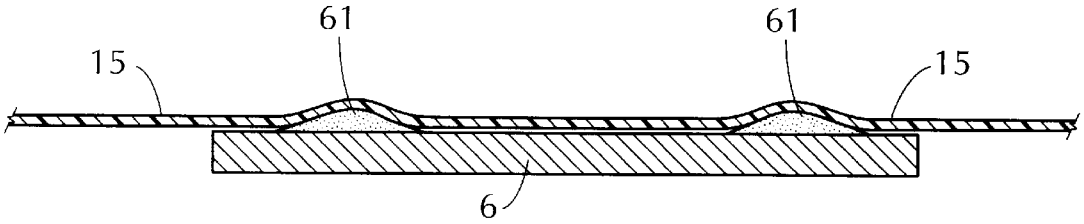
Figure 16E:
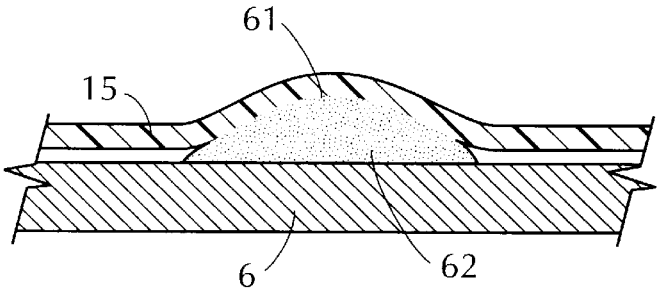

FIGS. 16D and E show an alternate embodiment wherein a bead of hot melt adhesive 62 is applied to front panel 6 in the same pattern as member 9. The hot melt adhesive can be premixed with metal particles such as iron or aluminum or bead 62 can be flocked while still hot with iron or aluminum particles 61. A magnet can be used to orient iron particles 61 for better bonding to film 15 (FIG. 16E).

FIGS. 9–12 show an alternate embodiment wherein pour door 202 with a recessed center section 203 snaps into frame 204 which is mounted to a dispensing opening 214 in end wall 43 of carton 1.

Metal foil laminate 205 (similar to members 9, 13, 131 and 133) is perforated along line 205' and is adhered to the interior of end wall 43 over opening 214.

Liner 15 is adhered via laminate 205 using the process of FIG. 19 to the interior end wall 43 surrounding opening 214 and to recessed portion 203 of door 202. When pour door 202 is lifted up the first time, portion 15' separates from liner 15 along line 205' providing access to the contents thereof. Initial separation of portion 15' takes place where opening 214 is pointed (at 206) which offers less resistance than trying to tear an entire side at one time.

Liner 15 and its contents remain aligned with opening 214 because the liner 15 is adhered via member 205 to end wall 43 around opening 214.

Figure 20:
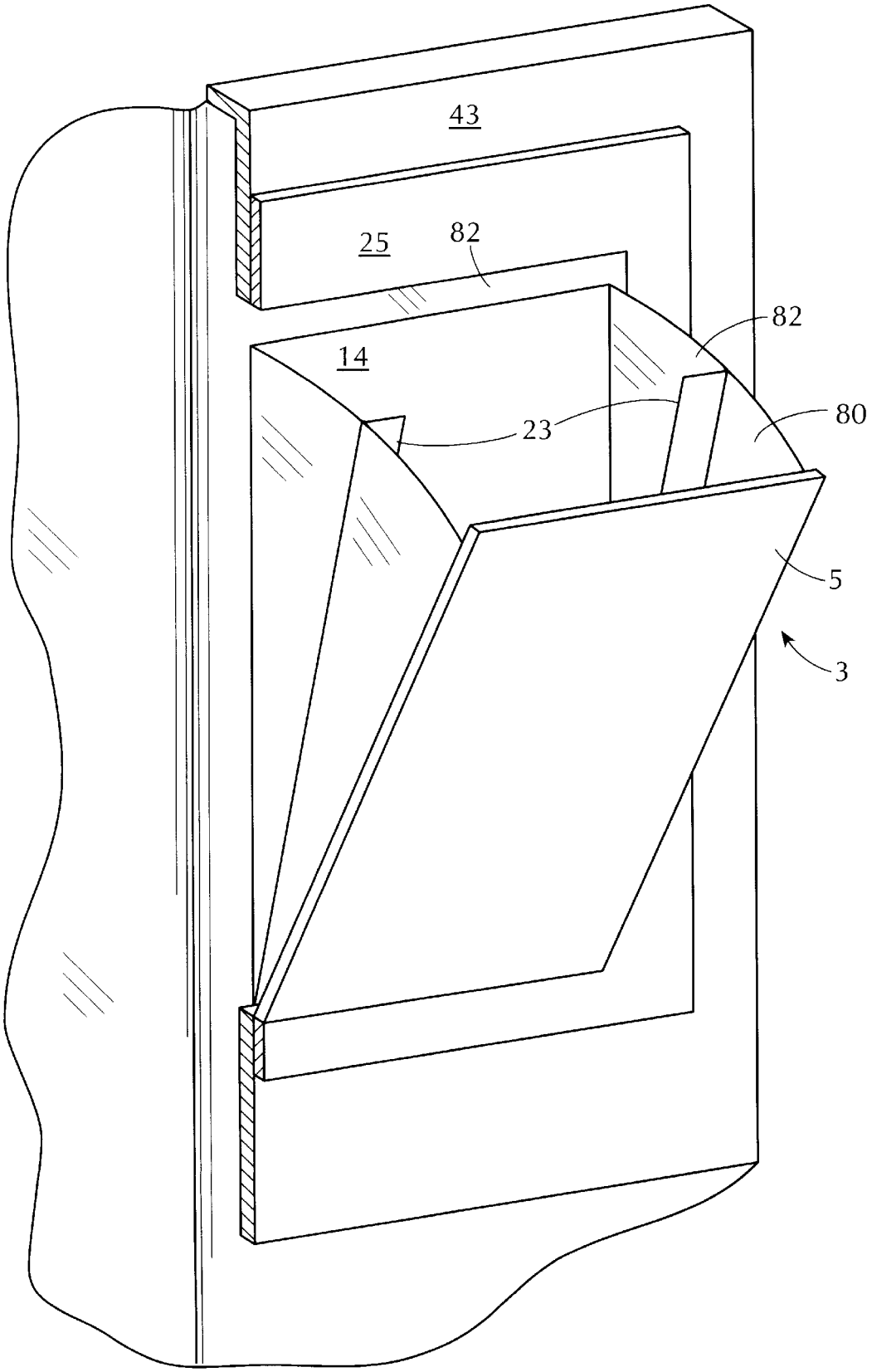
FIG. 20 is a perspective view of an alternate embodiment of the present invention partly broken away.

FIG. 20 is a perspective of an alternate embodiment for a container of the present in invention. The pour spout 3 includes bezel 25 that is affixed directly to end wall 43, front panel 5 that is hingedly attached to bezel 25, and flexible side panels 80 which are attached to front panel 5 by conventional adhesive. Side panels 80 bond to liner 15 at seams 23. Bonding between the side panels 80 and the liner 15 is achieved by the process shown in FIG. 19.

Figure 21:
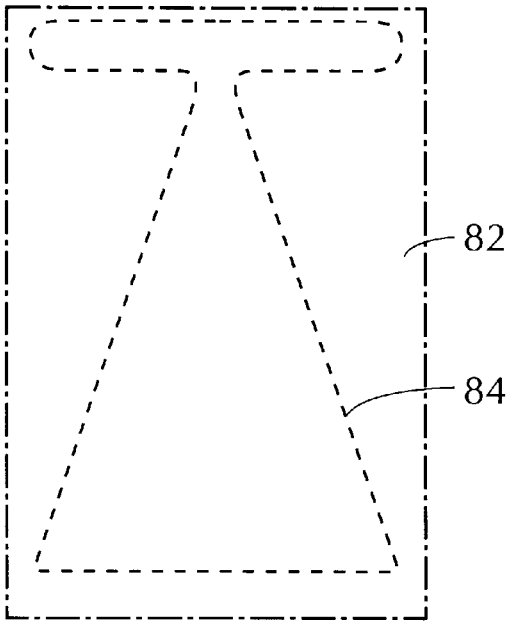
FIG. 21 shows a perforation pattern on the liner of the embodiment of FIG. 20.

When the pour spout is opened for the first time, flexible side panels 80 pull and tear the liner 15 along tear lines 84 shown in FIG. 21. As flexible side panels 80 pull and tear liner 15, portions 82 the liner extend and form the side walls of spout 3 with side panels 80.

Figure 22:
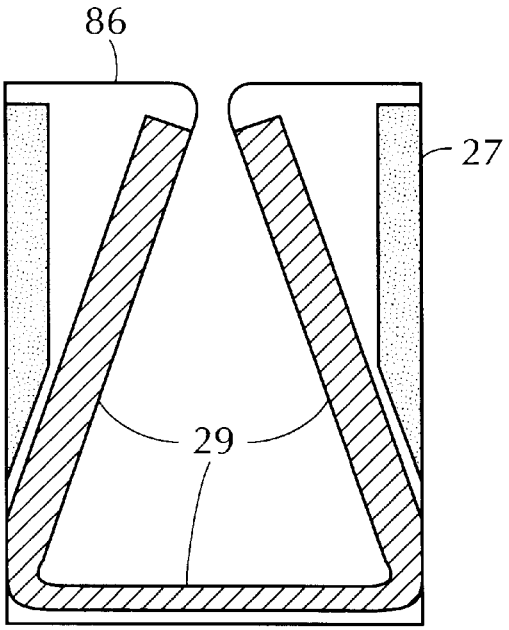
FIG. 22 is a plan view of a member which partly forms the side panels of the embodiment of FIG. 20.

Flexible side panels 80 are preferably formed by a single sheet of flexible material 86 as shown in FIG. 22 with conventional adhesive 27 applied to the edge which bonds to the pour spout front panel 5. Foil laminate bonding member 29 (similar to member 9) bonds to corresponding edges of portions 82 of liner 15 to form seams 23 in the side panels 80, 82.

What is claimed is:

1. Dispensing assembly comprising:

(a) a carton having a dispensing opening in a side wall thereof and separate liner means therein;

(b) a pour spout mounted in said dispensing opening pivotable between open and closed positions and including a front panel having an upper edge which slopes downward from a high corner;

(c) said liner being bonded to said front panel whereby upon initial opening of the pour spout that portion of the liner bonded to the high corner of said front panel provides an area of reduced resistance to initiate separation from said liner providing access to the interior thereof.

2. Dispensing assembly of claim 1 wherein said front panel includes means to promote bonding with said liner.

3. Dispensing assembly of claim 2 wherein said means to promote bonding comprises a heat generator and a heat activatable adhesive.

4. Dispensing assembly of claim 3 wherein the heat generator is selected from the group consisting of a metal foil, a metallic salt or metal particles.

5. Dispensing assembly of claim 1 wherein said liner is also bonded to the interior of said carton adjacent at least one side of the dispensing opening.

6. Dispensing assembly comprising:

(a) a carton having side and end walls and separate liner adapted to contain particulate product therein;

(b) an access panel severably connected to one wall of said carton and pivotable at an integral base thereof;

(c) a fitment having a dispensing opening and an upper margin portion attached to the interior of said end wall such that said access panel overlies said dispensing opening; and (d) a pour spout having side panels and a front panel having an upper edge which slopes downward from a high corner, said front panel being bonded on one side to the interior of said access panel to pivot therewith between open and closed positions, and on the other side to said liner such that upon initial opening of the pour spout, that portion of the liner bonded to the high corner of said front panel provides an area of reduced resistance to initiate separation from said liner providing access to the contents thereof.

7. Dispensing assembly of claim 6 wherein said fitment includes side members adjacent said dispensing opening forming a narrow space with the side walls of said carton for receiving the side panels of said pour spout.

8. Dispensing assembly of claim 7 wherein the side members of said fitment have means adjacent said dispensing opening to promote bonding with said liner.

9. Dispensing assembly of claim 6 wherein the front panel of said spout means has tab means adapted to interlock with releasable locking means in the upper margin portion of said fitment means.

10. Dispensing assembly of claim 6 wherein the end wall having said access panel has a removable section overlying a segment of the upper margin portion of said fitment adjacent said dispensing opening.

11. Process for making a dispensing assembly comprising:

(a) providing carton means having a dispensing opening in a side wall thereof, pour spout means mounted in said dispensing opening and including a front panel and separate liner means in said carton;

(b) bonding said liner means to said front panel whereby upon initial opening of the pour spout means, that portion of the liner bonded to said front panel separates from said liner means providing access to the interior thereof.

12. Process of claim 11 wherein said liner is filled and sealed and means are employed to bring said portion of said liner into contact with said front panel for bonding thereto.

13. Process of claim 12 wherein said carton is exposed to an area of reduced pressure to bring a portion of said liner means into contact with said front panel for bonding thereto.

14. Process of claim 11 wherein said front panel is provided with means to promote bonding to said liner and means are employed to deliver bonding energy to the interface between said front panel and said liner.

15. Process of claim 11 wherein the means to promote bonding comprises heat generating means and heat activatable adhesive means and means are employed to deliver heat energy to said heat generating means to seal said liner to said front panel.

16. Process of claim 15 wherein said heat generating means is a metal foil, a metallic salt or metal particles and said means to deliver heat energy comprises induction heating means.

* * * * *